US005379530A

United States Patent [19]

Bell et al.

[11] Patent Number: 5,379,530

[45] Date of Patent: * Jan. 10, 1995

[54] MULTI-APPLICATION ANKLE SUPPORT FOOTWEAR

[75] Inventors: Anthony H. G. Bell, Laguna Niguel; Carl E. Prindle, South Laguna Beach, both of Calif.

[73] Assignee: Oansh Designs, Ltd., Laguna Niguel, Calif.

[ * ] Notice: The portion of the term of this patent subsequent to Jun. 7, 2011 has been disclaimed.

[21] Appl. No.: 153,651

[22] Filed: Nov. 16, 1993

Related U.S. Application Data

[63] Continuation of Ser. No. 933,328, Aug. 21, 1992, Pat. No. 5,317,820.

[51] Int. Cl.[6] ..... A43B 7/20; A43B 23/08

[52] U.S. Cl. ..... 36/89; 36/114; 36/58.5; 36/69

[58] Field of Search ..... 36/89, 90, 114, 58.5, 36/58.6, 69, 140, 50.1

[56] References Cited

U.S. PATENT DOCUMENTS

| | | | |
|---|---|---|---|
| 398,892 | 3/1889 | Golden | 36/89 X |
| 487,492 | 12/1892 | Pugsley | 36/89 X |
| 730,366 | 6/1903 | Gunthorp . | |
| 950,862 | 3/1910 | Nelson | 36/58.5 |
| 1,205,206 | 11/1916 | Hofmeister . | |
| 1,210,255 | 12/1916 | Attschul | 36/89 |
| 1,610,700 | 12/1926 | Morton . | |
| 1,692,896 | 11/1928 | Hilgert . | |
| 1,717,432 | 6/1929 | Botti | 36/90 |
| 2,302,694 | 11/1942 | Jennings | 36/89 |
| 2,800,900 | 7/1957 | Schultz . | |
| 2,994,322 | 8/1961 | Cullen et al. . | |
| 3,138,880 | 6/1964 | Kunzli | 36/114 |
| 3,584,622 | 6/1971 | Domenico . | |
| 3,613,273 | 10/1971 | Marquis | 36/89 |
| 4,166,460 | 9/1979 | Applegate . | |

(List continued on next page.)

FOREIGN PATENT DOCUMENTS

| | | | |
|---|---|---|---|
| 0146208 | 6/1985 | European Pat. Off. . | |
| 8730066 | 7/1989 | European Pat. Off. . | |
| 2637277 | 2/1978 | Germany . | |
| 8322899 | 9/1983 | Germany . | |
| 0662483 | 10/1987 | Switzerland | 36/89 |

OTHER PUBLICATIONS 8 page brochure by Bauerfeind re: Malleotrain/Malleoloc device.

6 page brochure featuring Malleoloc Ankle orthosis.

*Primary Examiner*—Paul T. Sewell
*Assistant Examiner*—Ted Kavanaugh
*Attorney, Agent, or Firm*—Stetina Brunda & Buyan

[57] ABSTRACT

An ankle supporting shoe comprising a sole member. Attached to the top surface of the sole member is a midsole including a planar portion having a continuous flange formed partially about and extending upwardly from the planar portion. Attached to the upper surface of the midsole and a toe portion of the top surface of the sole member is a structural member including a base portion formed to suit the shape of the wearer's foot and lateral and medial struts extending upwardly from the base portion. A boot is attached to the sole member in a manner wherein the lateral strut extends between the outer surface of a lateral side portion of the boot and the inner surface of the flange, with the medial strut extending between the outer surface of a medial side portion of the boot and the inner surface of the flange. Upper and lower strap members are engaged to the shoe which, when tightened, cause the lateral strut to extend about the front of the lateral malleolus of the ankle and the medial strut to extend behind the medial malleolus of the ankle.

16 Claims, 3 Drawing Sheets

U.S. PATENT DOCUMENTS

| | | | |
|---|---|---|---|
| 4,255,877 | 3/1981 | Bowerman | 36/69 X |
| 4,305,212 | 12/1981 | Coomer | 36/69 X |
| 4,342,161 | 8/1982 | Schmohl | 36/114 |
| 4,510,701 | 4/1985 | Schour et al. | 36/69 X |
| 4,547,981 | 10/1985 | Thais et al. | 36/114 |
| 4,577,419 | 3/1986 | Chassaing . | |
| 4,676,011 | 6/1987 | O'Rourke et al. | 36/89 |
| 4,719,926 | 1/1988 | Nelson . | |
| 4,766,681 | 8/1988 | O'Rourke et al. | 36/89 |
| 4,776,111 | 10/1988 | Crowley | 36/89 X |
| 4,811,502 | 3/1989 | Barret | 36/58.5 X |
| 4,854,055 | 8/1989 | Sugiyama et al. | 36/89 X |
| 4,862,900 | 9/1989 | Hefele . | |
| 4,864,741 | 9/1989 | Beauchemin . | |
| 4,989,350 | 2/1991 | Bunch et al. . | |
| 5,038,762 | 8/1991 | Hess et al. . | |
| 5,056,509 | 10/1991 | Swearington . | |
| 5,109,613 | 5/1992 | Van Dyke | 36/114 X |
| 5,131,173 | 7/1992 | Anderie . | |
| 5,152,082 | 10/1992 | Culpepper | 36/69 X |
| 5,175,947 | 1/1993 | Parracho | 36/89 |
| 5,269,078 | 12/1993 | Cochrane | 36/50.1 X |

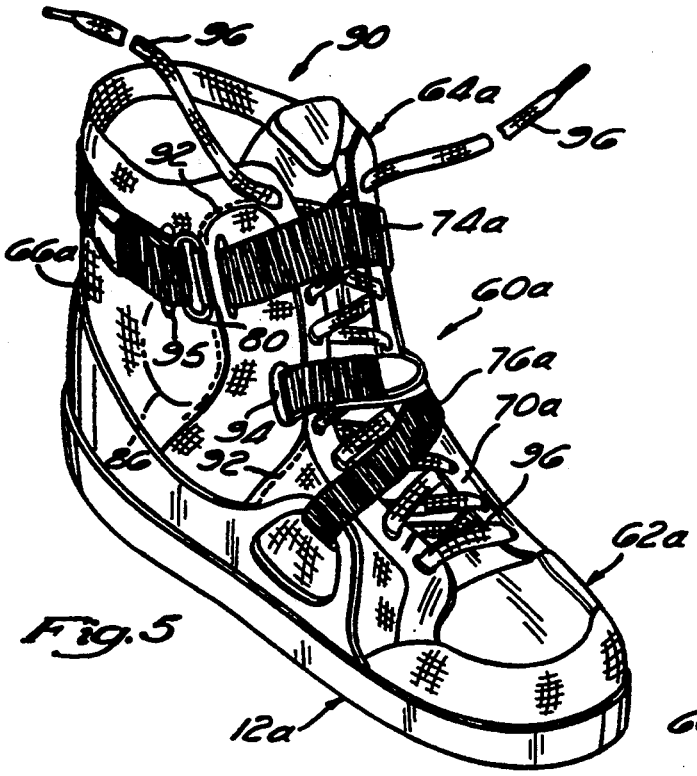
Fig. 5
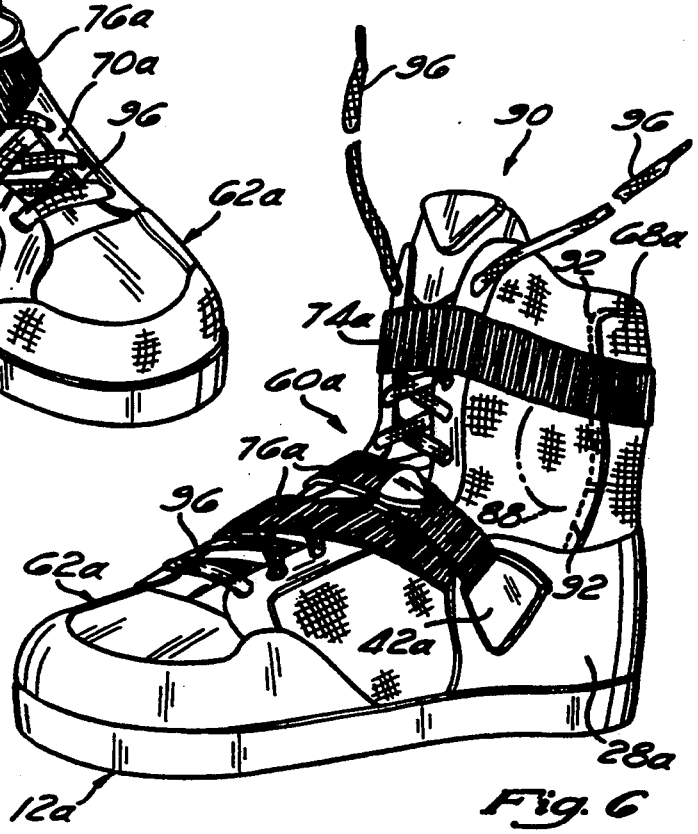
Fig. 6
Fig. 7
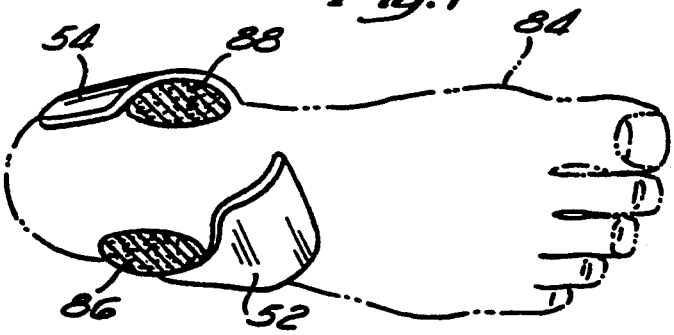

MULTI-APPLICATION ANKLE SUPPORT FOOTWEAR

This application is a continuation of application Ser. No. 07/933,328, filed Aug. 21, 1922 U.S. Pat. No. 5,317,820.

FIELD OF THE INVENTION

The present invention relates generally to footwear, such as shoes, and more particularly to an athletic shoe incorporating a structural member for providing lateral and medial support to the ankle of the shoe wearer.

BACKGROUND OF THE INVENTION

Ankle injuries resulting from forced internal rotation and flexion of the ankle joint are commonly seen in work and sport activities and routinely result from participation in sports, such as running, tennis, basketball, and hiking. These ankle injuries vary in severity from simple ligament pulls to ligament ruptures and bone fractures. In certain cases, lengthy time periods are required to achieve full recovery, though many types of sprains tend to recur. In recognition of the frequent occurrences of these injuries, it has been a common practice for athletes to protect themselves from such injuries through the use of orthopedic devices which limit the natural ankle movements that are normally encountered in the course of walking or running. These orthopedic devices are typically provided in the form of ankle braces, elastic bandages or the like, made of stiff material, laced, wrapped or otherwise attached to the ankle. However, these types of support devices have not been very popular among the public due to such devices having the effect of excessively restricting most of the ankle's movements thus resulting in poor athletic performance, as well as being difficult and time-consuming to install upon the ankle and uncomfortable to wear.

Due to these deficiencies associated with conventional ankle braces and the related techniques used to prevent sports related ankle injuries, various types of prior art athletic shoes have been developed in an attempt to incorporate structures adapted to provide support to the ankle of the wearer. Examples of such prior art devices include shoes which are formed to include a high-top upper portion having a cushioning portion commencing just below the ankle and extending over the lower portion of the leg at the ankle opening. Other types of prior art shoe constructions range from an essentially unitary sheet panel covering the entire upper portion of the shoe, to diverse arrangements of textile sheet portions and leather reinforcement portions which act to distribute stresses within the shoe to prevent injury to the ankle.

Though the prior art shoe designs attempt to provide adequate support to the foot of the wearer so as to prevent strains or other injury to the ankle resulting from excess movement of the ankle joint, such prior art constructions do not fully achieve their objective due to the competing demands of shoe flexibility and light weight, with the desirability of providing full support. As such, in addition to using the prior art ankle supporting shoes, athletes generally tape their feet to provide additional support when playing strenuous games. Though certain prior art athletic shoes such as that disclosed in U.S. Pat. No. 4,989,350 to Bunch et al. attempt to overcome the known deficiencies of other prior art athletic shoes by incorporating strut and support strap arrangements, these and other similar shoes are also generally deficient in that they do not provide uniform support to the entire foot of the shoe wearer. The present invention overcomes the deficiencies associated with prior art ankle supporting shoes by providing an ankle supporting shoe which is adapted to provide full support to the foot of the wearer.

SUMMARY OF THE INVENTION

In accordance with a preferred embodiment of the present invention, there is provided an ankle-supporting shoe comprising a sole member defining lateral and medial edges and a generally planar top surface having heel, toe and central portions. Attached to the sole member is a boot including lateral and medial side portions which define a pair of adjacent edges. The boot preferably comprises a foot portion surrounding the foot of the wearer and an ankle portion surrounding the lower area of the shin and calf of the wearer.

Attached to the top surface of the sole member is a structural member comprising a base portion formed to suit the shape of the wearer's foot and sized to extend substantially along the entire length of the wearer's foot. Extending upwardly from the base portion are lateral and medial struts. Cooperatively engaged to both the boot and lateral and medial struts is a fastening means which is selectively tightenable, and operable to tighten the structural member when tightened. In this regard, the tightening of the structural member via the fastening means serves to compress the boot such that the lateral and medial side portions of the boot are secured to each other along the adjacent edges thereof, thus maintaining the shoe upon the wearer's foot. Advantageously, the lateral strut is formed and oriented so as to extend about the front of the lateral malleolus and along the lateral and frontal aspects of the ankle when the wearer's foot is inserted into the boot and the fastening means tightened. Additionally, the medial strut is formed and oriented so as to extend behind the medial malleolus and along the medial aspect of the ankle when the wearer's foot is inserted into the boot and the fastening means tightened.

The shoe of the present invention may further include a midsole comprising a planar portion which is attached to the top surface of the sole member and disposed between the sole member and the base portion of the structural member. The planar portion defines a peripheral edge and is preferably sized to substantially cover the heel and central portions of the top surface when attached thereto. Formed partially about and extending upwardly from the peripheral edge of the planar portion is a continuous flange. The flange extends about the heel portion of the top surface and has a first end extending along the lateral edge of the sole member to the toe portion of the top surface and a second end extending along the medial edge of the sole member to the central portion of the top surface. Disposed in the first end of the flange is a first aperture, while disposed in the second end of the flange is a second aperture.

In a first embodiment of the present invention, the boot is attached to the sole member in a manner wherein the lateral strut extends between the outer surface of the lateral side portion of the boot and the inner surface of the flange with the medial strut extending between the outer surface of the medial side portion of the boot and the inner surface of the flange. The lateral strut is additionally attached to the outer surface of the lateral side portion with the medial strut being attached to the outer surface of the medial side portion. Additionally, the lateral strut is formed to include upper and lower apertures therein.

The fastening means constructed in accordance with the first embodiment of the present invention comprises an elongate lower strap which extends over the foot and ankle portions of the boot and has a first proximal end which is extended through the first aperture of the flange and secured to a first proximal portion of the lower strap. The lower strap further includes a first distal end which is extended through the second aperture of the flange and lower aperture of the lateral strut and releasably attached to a first distal portion of the lower strap. The fastening means further comprises an elongate upper strap which extends about the ankle portion of the boot, including the upper portions of the lateral and medial struts. The upper strap has a second proximal end which is extended through the upper aperture of the lateral strut and secured to a second proximal portion of the upper strap. The upper strap further includes a second distal end which extends through a loop member disposed about the second proximal portion and is releasably attached to a second distal portion of the upper strap. In the first embodiment, the upper strap and medial strut are adapted to be releasably attachable to each other when the upper strap is extended thereabout.

In a second embodiment of the present invention, the boot is attached to the sole member in a manner wherein the lateral strut extends within the lateral side portion of the boot and the medial strut extends within the medial side portion of the boot, thus making the lateral and medial struts integral with the boot. The fastening means constructed in accordance with the second embodiment of the present invention comprises an elongate lower strap which extends over the foot and ankle portions of the boot and has a first proximal end which is extended through the first aperture of the flange and secured to a first proximal portion of the lower strap. A first distal end of the lower strap is extended through the second aperture of the flange and through the lower aperture of the lateral strut via an opening disposed within the lateral side portion of the boot, with the first distal end being releasably attached to a first distal portion of the lower strap. The fastening means of the second embodiment further includes an elongate upper strap which extends about the ankle portion of the boot. The upper strap has a second proximal end which is extended through the upper aperture of the lateral strut via an opening disposed within the lateral side portion of the boot, and secured to a second proximal portion of the upper strap. The upper strap further includes a second distal end which extends through a loop member disposed about the second proximal portion and is releasably attached to a second distal portion of the upper strap. In the second embodiment, the upper strap is adapted to be releasably attachable to a portion of the medial side portion of the boot when extended thereabout. In addition to including the upper and lower straps, the fastening means of the second embodiment further comprises shoelaces for securing the adjacent edges of the lateral and medial side portions of the boot to each other.

Further in accordance with the present invention, there is provided a method for constructing a shoe comprising the step of attaching a midsole to the generally planar top surface of a sole member of the shoe. After the midsole is attached to the top surface of the sole member, a structural member is attached to the upper surface of the midsole and a toe portion of the top surface. Thereafter, a boot is attached to the'sole member in a manner wherein a lateral strut of the structural member extends between a flange of the midsole and a lateral side portion of the boot, with a medial strut of the structural member extending between the flange of the midsole and a medial side portion of the boot. The lateral strut is then secured to the outer surface of the lateral side portion with the medial strut being secured to the outer surface of the medial side portion. Alternatively, the boot may be attached to the sole member in a manner where the lateral and medial struts extend within and are integral with the lateral and medial side portions.

BRIEF DESCRIPTION OF THE DRAWINGS

These, as well as other features of the present invention, will become more apparent upon reference to the drawings wherein:

FIG. 5 is a lateral side perspective view of a shoe constructed in accordance with a second embodiment of the present invention;

FIG. 6 is a medial side perspective view of the shoe shown in FIG. 5; and FIG. 7 is a top view illustrating the manner in which the lateral and medial struts of the shoes constructed in accordance with the first and second embodiments are oriented relative the lateral and medial malleolus of the ankle.

DETAILED DESCRIPTION OF THE PREFERRED EMBODIMENT

Figure 1:
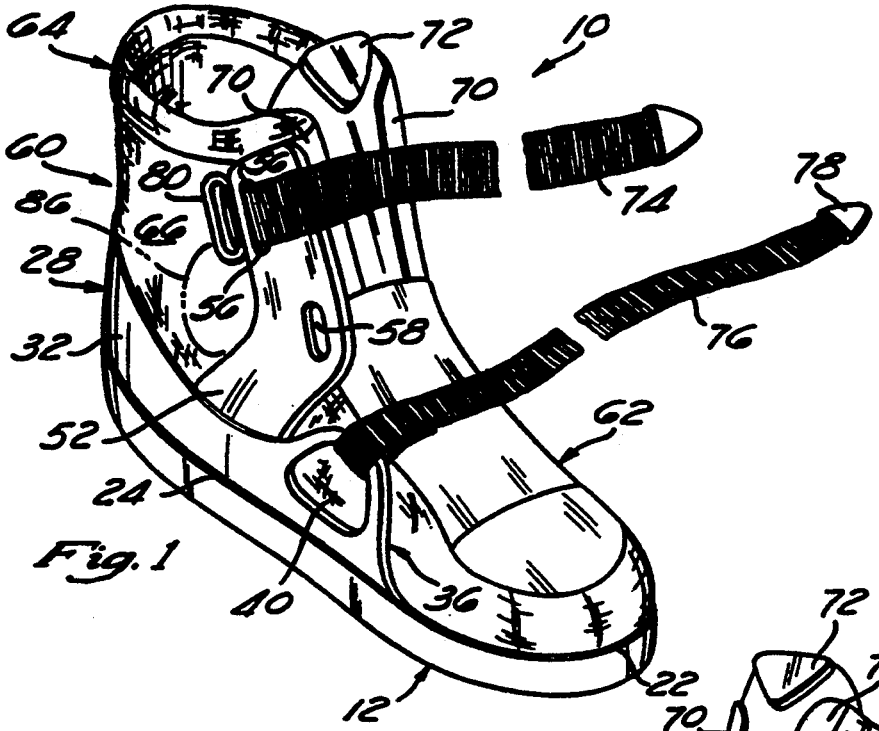
FIG. 1 is a lateral side perspective view of a shoe constructed in accordance with a first embodiment of the present invention.
Figure 2:
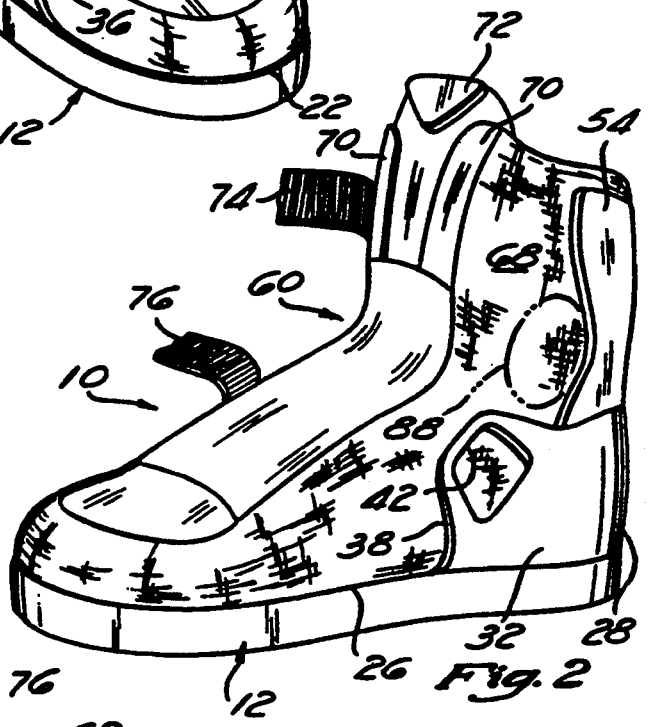
FIG. 2 is a medial side perspective view of the shoe shown in FIG. 1.
Figure 3:
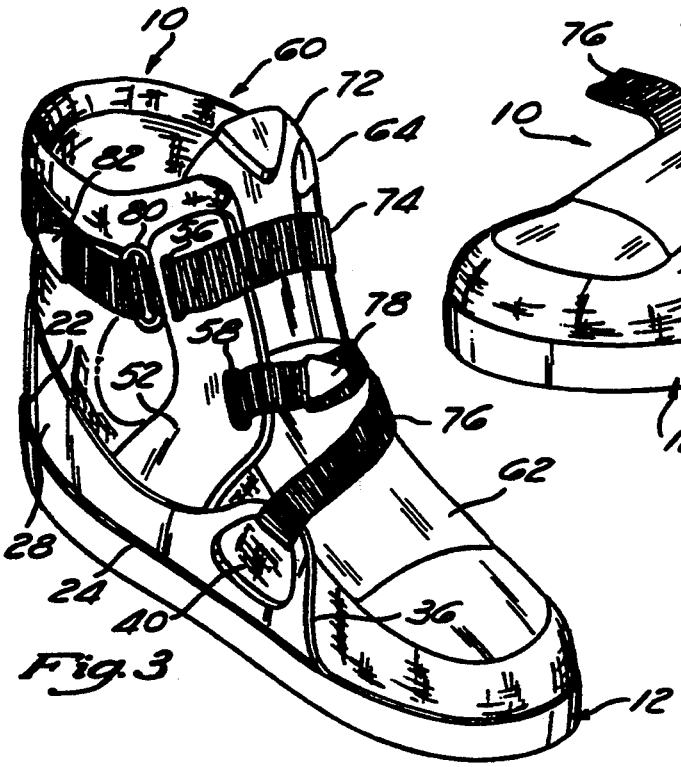
FIG. 3 is a lateral side perspective view of the shoe of the first embodiment illustrating the fastening means associated therewith being fully tightened to maintain the shoe upon the wearer's foot.

Referring now to the drawings wherein the showings were for purposes of illustrating preferred embodiments of the present invention only, and not for purposes of limiting the same, FIGS. 1–3 perspectively illustrate a shoe 10 constructed in accordance with a first embodiment of the present invention. As seen in FIGS. 1–3, shoe 10 is an athletic shoe in the form of a high-top basketball shoe, though it will be recognized that the ankle supporting structural components of the shoe 10 as will hereinafter be described may be incorporated into other types of footwear such as hiking boots, cross-training shoes, sandals, etc.

Referring now to FIGS. 1–4, the ankle supporting shoe 10 generally comprises a sole member 12 defining a generally planar top surface 14 having heel portion 16, toe portion 18 and central portion 20. Formed about and extending upwardly from the peripheral edge of the top surface 14 is a continuous wall 22 defining a lateral side 24 and a medial side 26. In the first embodiment, the sole member 12 is fabricated from rubber or a similar material.

Attached to the top surface 14 of the sole member 12 is a midsole 28. Midsole 28 generally comprises a planar portion 30 which defines an upper surface 31 and is sized to substantially cover the heel portion 16 and central portion 20 of the top surface 14 when attached to the sole member 12. Formed partially about and extending upwardly from the planar portion 30 is a continuous flange 32 defining an inner surface 34, a first end 36, and a second end 38. When the midsole 28 is attached to the sole member 12, the flange 32 extends about the heel portion 16 of the top surface 14, with the first end 36 extending along the lateral side 24 of the wall 22 to the toe portion 18 of the top surface 14, and the second end 38 extending along the medial side 26 of the wall 22 to the central portion 20 of the top surface 14. Disposed in the first end 36 of the flange 32 is a first aperture 40, while disposed in the second end 38 of the flange 32 is a second aperture 42. The use of the first aperture 40 and second aperture 42 will be discussed below. Like the sole member 12, midsole 28 is also preferably fabricated from rubber, though other materials may be utilized as an alternative.

Figure 4:
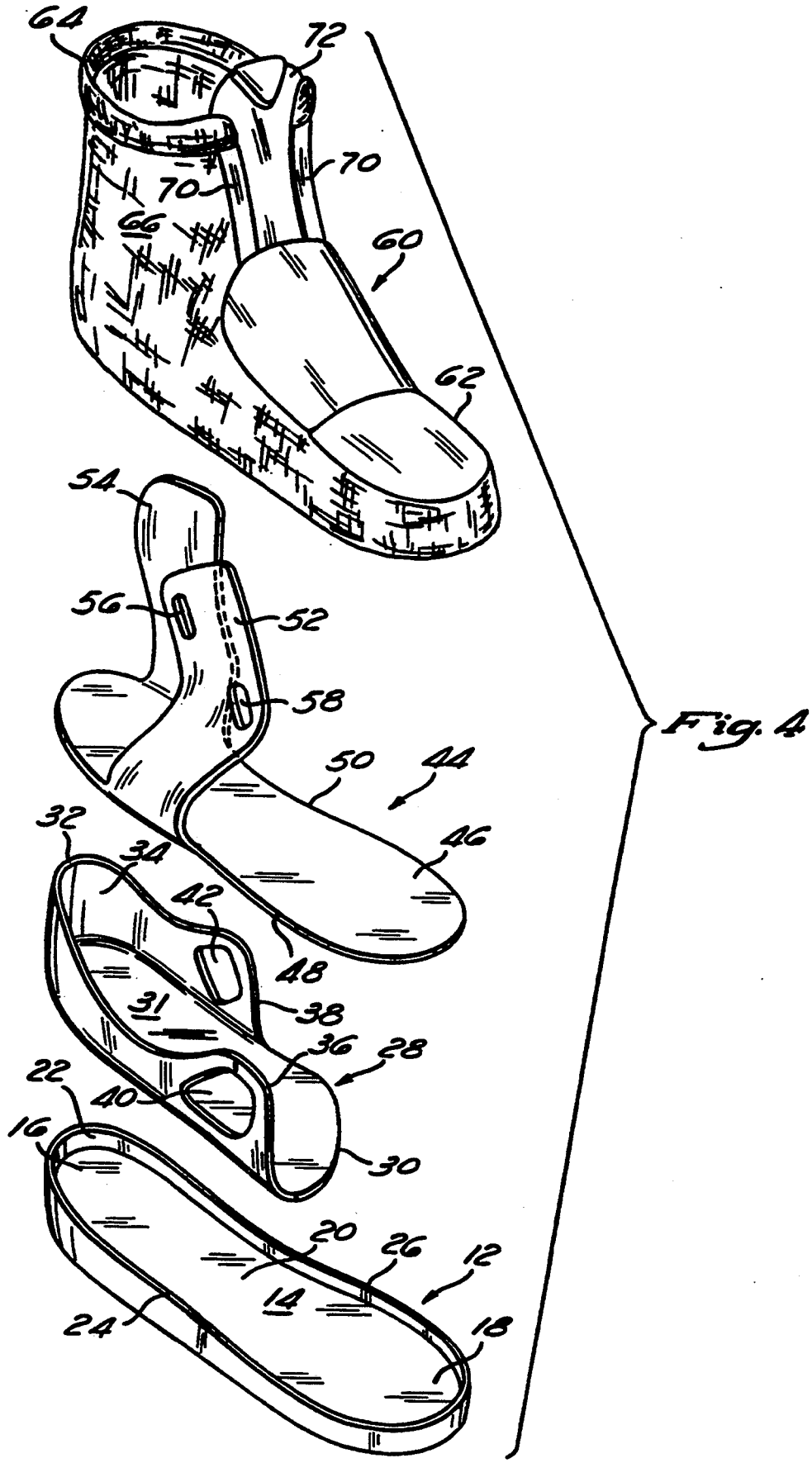
FIG. 4 is an exploded view of the components comprising the shoe shown in FIGS. 1–3.

Attached to the upper surface 31 of midsole 28 and to the toe portion 18 of the top surface 14 is a structural or brace member 44. In the first embodiment, structural member 44 generally comprises a base portion 46 which is formed to suit the shape of the wearer's foot and sized to extend substantially along the entire length of the wearer's foot. As such, the base portion 46 will completely cover the upper surface 31 of the midsole 28 and the toe portion 18 of the top surface 14 when attached thereto. As best seen in FIG. 4, the base portion 46 has a shape complimentary to the top surface 14 of the sole member 12. However, since the midsole 28 is disposed between the top surface 14 and base portion 46, the base portion 46 is secured directly to the upper surface 31 and only the toe portion 18 of the top surface 14.

Extending upwardly from the lateral edge 48 of the base portion 46 is a lateral strut 52, while extending upwardly from the medial edge 50 of the base portion 46 is a medial strut 54. In the first embodiment, the lateral strut 52 has a curved configuration and includes an upper portion having an upper aperture 56 disposed therein and a lower portion having a lower aperture 58 disposed therein. The use of the lateral and medial struts 52, 54 as well as the upper and lower apertures 56, 58 will be explained below. It will be recognized that the midsole 28 may be eliminated from the shoe 10 by modifying the configuration of the structural member 44 to include one or more flange portions extending upwardly from the lateral and medial edges 48,50 of the base portion 46 which define apertures similar to the apertures 40,42 previously described. Such apertures may also be defined within one or more flange portions extending upwardly from the peripheral edge of the sole member 12.

Attached to the sole member 12 is a boot 60. In the first embodiment, the boot 60 includes a foot portion 62 surrounding the foot of the wearer, a vamp portion 63 and an ankle portion 64 surrounding the lower area of the shin and calf of the wearer. The boot 60 further includes a lateral side panel portion 66 and a medial side panel portion 68, each of which define outer surfaces and adjacent edges 70. Extending between the adjacent edges 70 of the lateral and medial side portions 66, 68 is a tongue member 72. As best seen in FIGS. 1, 2 and 4, the boot 60 is formed such that the adjacent edges 70 extend only partially along the ankle portion 64 and do not extend into the foot portion 62. In the first embodiment, the boot 60 is fabricated from a durable, pliable material such as leather, though other materials may be utilized as an alternative.

As seen in FIGS. 1–3, in the first embodiment, boot 60 is attached to the sole member 12 in a manner wherein the lateral strut 52 extends between the outer surface of the lateral side portion 66 and the inner surface 34 of the flange 32. Similarly, the medial strut 54 extends between the outer surface of the medial side portion 68 and the inner surface 34 of the flange 32. The lateral strut is preferably attached to the outer surface of the lateral side portion 66 with the medial strut 54 being attached to the outer surface of the medial side portion 68. The lateral and medial struts 52, 54 are preferably attached to the respective outer surfaces via stitching, though adhesives or other attachment means may also be utilized.

To tighten the lateral and medial struts 52,54 of the structural member 44 about the wearer's ankle and maintain the shoe 10 upon the foot of the wearer, included therewith is a T-strap pull mechanism comprising an elongate upper strap 74 and an elongate lower strap 76. As seen in FIG. 1, the lower strap 76 is secured to the shoe 10 by extending the proximal end thereof through the first aperture 40 of the midsole 28 and securing the same to a proximal portion of the lower strap 76. The distal end of the lower strap 76 is then extended through the second aperture 42 of the midsole 28 and the lower aperture 58 of the lateral strut 52, respectively, in the manner shown in FIG. 3. After being extended through the lower aperture 58, the distal end of the lower strap 76 is releasably attached to a distal portion of the lower strap 76. In the first embodiment, the releasable attachment is facilitated by a Velcro fastener 78 disposed on the distal end of the lower strap 76. As also seen in FIG. 3, the lower strap 76 extends over the foot portion 62 as well as the vamp portion 63 of the boot 60 when engaged to the shoe 10. As will be recognized, the lower strap 76 is directly interfaced to the shoe 10 at three locations which, together, generally define a "T". In this regard, the first aperture 40 of the midsole 28 and the lower aperture 58 of the lateral strut 52 define the opposed ends of the top of the "T", while the second aperture 42 of the midsole 28 defines the lower-most end of the "T". The advantages attendent to arranging the first and second apertures 40,42 and lower aperture 58 in the T-shaped configuration will be discussed below.

The upper strap 74 is attached to the shoe 10 by extending the proximal end thereof through the upper aperture 56 of the lateral strut 52 and securing the same to a proximal portion of the upper strap 74. Thereafter, the upper strap 74 is extended about the ankle portion 64 of the boot 60 in the manner shown in FIG. 3, with the distal end thereof being extended through a loop member 80 secured to the proximal portion of the upper strap 74. After being extended through the loop member 80, the distal end of the upper strap 74 is releasably attached to the distal portion thereof via a Velcro fastener 82 disposed on the distal end. Importantly, when the upper strap 74 is extended about the ankle portion 64, such is extended over the upper portion of the lateral strut 52 as well as the upper portion of the medial strut 54. Though not shown, disposed on the outer surface of the upper portion of the medial strut 54 is a Velcro patch which is adapted to be releasably engageable to the upper strap 74 when such is extended thereabout.

Referring now to FIG. 7, when the foot 84 of the wearer is inserted into the boot 60 of the shoe 10 and rested upon the base portion 46 of the structural member 44, the tightening of the upper and lower straps 74, 76 in the manner shown in FIG. 3 tightens the structural member 44 due to the engagement of the upper and lower straps 74,76 thereto, which in turn causes the lateral and medial struts 52,54 to assume particular orientations relative the ankle of the wearer's foot 84. Particularly, the lateral strut 52 is formed and oriented on the lateral edge 48 of the base portion 46 so as to extend about the front of the lateral malleolus 86 of the ankle and upwardly along the lateral and frontal aspects of the ankle. Additionally, the medial strut 54 is formed and oriented on the medial edge 50 of the base portion 46 so as to extend behind the medial malleolus 88 of the ankle and upwardly along the medial aspect of the ankle. As previously indicated, the lateral and medial struts 52, 54 assume these particular orientations when the upper and lower straps 74, 76 are tightened. Advantageously, due to the T-shaped layout of the first and second apertures 40,42 and lower aperture 58, the tightening of the lower strap 76 facilitates the pulling of the lateral side of the shoe 10 toward the medial side thereof which reduces the risk of injury caused by ankle inversion. The tightening of the structural member 44 via the upper and lower straps 74, 76 further serves to compress the boot 60 which causes the adjacent edges 70 of the lateral and medial side portions 66, 68 to draw toward each other, thus maintaining the shoe 10 upon the foot of the wearer.

As will be recognized, the lateral strut 52 is maintained in the aforementioned orientation about the lateral malleolus 86 due to the direct engagement of the upper and lower straps 74, 76 thereto via the upper aperture 56 and lower aperture 58 disposed therein. Additionally, the medial strut 54 is maintained in the aforementioned orientation relative the medial malleolus 88 by the direct engagement of the upper strap 74 thereto via the Velcro patch disposed thereon. Advantageously, the aforementioned positioning of the lateral and medial struts 52, 54 provides support to the ankle of the wearer in a manner adapted to prevent injury thereto during strenuous athletic activity. Though the structural member 44 prevents the twisting or inversion of the ankle, it permits normal flexion of the ankle to occur, thus not excessively restricting the ankle's movements. The structural member 44 is preferably fabricated from a semi-rigid, plastic material possessing sufficient resiliency so as to allow the lateral and medial struts 52, 54 to be manipulated via the upper and lower straps 74, 76 to their desired orientations relative the lateral malleolus 86 and medial malleolus 88. Importantly, the pliable nature of the leather material preferably utilized to fabricate the boot 60 allows the lateral and medial struts 52, 54 to be manipulated to the proper orientations despite being attached to the outer surfaces of the lateral and medial side portions 66, 68.

As seen in FIG. 4, the shoe 10 is preferably fabricated by first attaching the midsole 28 to the top surface 14 of the sole member 12 in the aforementioned manner. Thereafter, the brace member 44 is attached to the upper surface 31 of the midsole 28 as well as the toe portion 18 of the top surface 14. When attached to the midsole 28 and top surface 14, the brace member 44 is oriented such that the lateral strut 52 extends upwardly from the lateral side 24 of the sole member 12, with the medial strut 54 extending upwardly from the medial side 26 of the sole member 12. Additionally, the midsole 28 is attached to the sole member 12 such that the first end 36 of the flange 32 extends along the lateral side 24, with the second end 38 of the flange 32 extending along the medial side 26.

After the midsole 28 and brace member 44 have been secured to the sole member 12, the boot 60 is attached thereto in the aforementioned manner such that the lateral and medial struts 52, 54 extend along the outer surfaces of the lateral and medial side portions 66, 68. Thereafter, the lateral strut 52 may be attached to the outer surface of the lateral side portion 66 and the medial strut 54 attached to the outer surface of the medial side portion 68.

Referring now to FIGS. 5 and 6, disclosed is a shoe 90 constructed in accordance with a second embodiment of the present invention. Shoe 90 is substantially similar to the shoe 10 previously discussed with respect to the first embodiment, except that in constructing shoe 90, the boot **60*a* is attached to the sole member 12*a* in a manner wherein the lateral and medial struts of the structural member extend within the lateral and medial side portions 65*a*, 68*a* of the boot 60*a* and are thus integral therewith. After being received into the boot 60, the lateral and medial struts of the structural member are preferably secured within the lateral and medial side portions 65*a*, 68*a* via stitching 92** which forms pockets sized to accommodate the lateral and medial struts.

To tighten the lateral and medial struts of the structural member about the wearer's ankle and maintain the shoe 90 upon the foot of the wearer, included is an upper strap **74*a* and a lower strap 75*a*. Lower strap 75*a* is interfaced to the shoe 90 in a manner similar to the interface of the lower strap 76 to the shoe 10, except that the distal end of the lower strap 75*a*, after being extended through the second aperture 42*a* of the midsole 28*a*, is extended through the lower aperture of the lateral strut via an opening 94 disposed within the lateral side portion 65*a* of the boot 60*a*. The upper strap 74*a* is also interfaced to the shoe 90 in a manner similar to the interface of the upper strap 74 to the shoe 10, except that the proximal end thereof is extended through the upper aperture of the lateral strut via an opening 95 disposed within the lateral side portion 65*a* of the boot 60*a*. The upper strap 74*a* is extended about the ankle portion 64*a*, and more particularly the outer surfaces of the lateral side portion 65*a* and medial side portion 68*a*. However, since the medial strut of the structural member is disposed within the medial side portion 68*a* of the boot 60*a*, the upper strap 74*a* is not directly engaged thereto. Rather, in the second embodiment, the upper strap 74*a* is releasably attached to a Velcro patch disposed on the outer surface of the medial side portion 68*a*** in an orientation overlying the medial strut disposed therein.

Boot **60*a* further differs from boot 60 in that the adjacent edges 70*a* defined by the lateral and medial side portions 65*a*, 68*a* extend through both the ankle portion 64*a* and foot portion 62*a*. As such, the shoe 90 further includes shoe laces 96 which are tightenable in a conventional manner to pull the adjacent edges 70*a* toward one another to maintain the shoe 90 upon the wearer's foot. Importantly, when the shoelaces 96 and upper and lower straps 74*a*, 75*a* are tightened, the lateral and medial struts of the brace member used in conjunction with the shoe 90 are caused to assume the same orientations relative the ankle as previously described and shown in FIG. 7. In this respect, the pliable nature of the leather material preferably utilized to fabricate the boot 60*a* allows the lateral and medial struts to be properly positioned relative the lateral malleolus 86 and medial malleolus 88 by the shoelaces 96 and upper and lower straps 74***a*, 75*a*. In the second embodiment, the shoe 90 is fabricated in a manner similar to that previously described, except that when attaching the boot 60*a* to the sole member 12*a*, the lateral strut is received into the lateral side portion 65*a* and the medial strut received into the medial side portion 68*a*. Thereafter, the lateral and medial struts may be maintained within complementary pockets formed in the boot 60*a* via the stitching 92 previously described.

Additional modifications and improvements of the present invention may also be apparent to those skilled in the art. Thus, the particular combination of parts described and illustrated herein is intended to represent only certain embodiments of the invention, and is not intended to serve as limitations of alternative devices within the spirit and scope of the invention.

What is claimed is:

1. An ankle supporting shoe wearable on a wearer's foot having a plantar surface, ankle, heel, shin, lateral malleolus and medial malleolus, said shoe comprising:

a sole member defining lateral and medial edges and a generally planar top surface having heel, toe and central portions;

a boot attached to said sole member, said boot defining a toe portion, a vamp portion and an ankle portion surrounding the ankle, heel and lower shin of the wearer's foot when such is inserted into the boot, said ankle portion including lateral and medial side panel portions; and a brace member attached to the top surface of said sole member, comprising:

a base portion formed to suit the shape of at least a portion of the plantar surface of the wearer's foot; and curved lateral and medial struts extending upwardly from said base portion;

said lateral strut being formed and oriented on the base portion so as to extend upwardly along the lateral aspect of the ankle and about the front of the lateral malleolus and subsequently along the lower lateral and frontal aspects of the shin when the foot is inserted into the boot and the boot tightened; and said medial strut being formed and oriented on the base portion so as to extend upwardly along the medial aspect of the ankle and about the back of the medial malleolus and subsequently along the lower medial aspect of the shin when the foot is inserted into the boot and the boot tightened.

2. The shoe of claim 1 further comprising:

a fastening means cooperatively engaged to said boot and said lateral and medial struts, said fastening means being selectively tightenable and operable to compress the boot when tightened to maintain the shoe upon the wearer's foot.

3. The shoe of claim 2 further including a midsole, comprising:

a planar portion attached to the top surface of said sole member and disposed between the sole member and the base portion of said brace member, said planar portion being sized to substantially cover the heel and central portions of said top surface;

a continuous flange formed partially about and extending upwardly from the planar portion, said flange extending about the heel portion of said top surface and having a first end extending along the lateral edge of the sole member to the toe portion of the top surface and a second end extending along the medial edge of the sole member to the central portion of the top surface;

a first aperture disposed in the first end of the flange; and a second aperture disposed in the second end of the flange.

4. The shoe of claim 3 wherein said boot is attached to said sole member in a manner wherein said lateral strut extends upwardly between said lateral side panel portion and said flange and said medial strut extends upwardly between said medial side panel portion and said flange.

5. The shoe of claim 4 wherein said lateral strut is attached to said lateral side panel portion and said medial strut is attached to said medial side panel portion.

6. The shoe of claim 5 wherein said lateral strut includes an upper portion having an upper aperture disposed therein and a lower portion having a lower aperture disposed therein.

7. The shoe of claim 6 wherein said fastening means comprises:

an elongate lower strap extending over the foot and vamp portions of the boot and having a first proximal end extending through the first aperture of the flange and secured to a first proximal portion of the lower strap, and a first distal end extending through the second aperture of the flange and the lower aperture of said lateral strut, said first distal end being releasably attachable to a first distal portion of the lower strap; and an elongate upper strap extending about the ankle portion of the boot and the lateral and medial struts and having a second proximal end extending through the upper aperture of said lateral strut and secured to a second proximal portion of the upper strap, and a second distal end extending through a loop member disposed about the second proximal portion, said distal end being releasably attachable to a second distal portion of the upper strap.

8. The shoe of claim 7 wherein said upper strap is releasably attachable to said medial strut.

9. The shoe of claim 6 wherein said boot is attached to said sole member in a manner wherein said lateral strut extends upwardly within said lateral side panel portion and said medial strut extends upwardly within said medial side panel portion.

10. The shoe of claim 9 wherein said fastening means comprises:

an elongate lower strap extending over the foot and vamp portions of the boot and having a first proximal end extending through said first aperture of the flange and secured to a first proximal portion of the strap, and a first distal end extending through said second aperture of the flange and said lower aperture of said lateral strut via a first opening disposed within said lateral side panel portion, said first distal end being releasably attachable to a first distal portion of the lower strap; and an elongate upper strap extending about the ankle portion of the boot and having a second proximal end extending through said upper aperture of said lateral strut via a second opening disposed within said lateral side panel portion and secured to a second proximal portion of the upper strap, and a second distal end extending through a loop member disposed about said second proximal portion, said second distal end being releasably attachable to a second distal portion of the upper strap.

11. The shoe of claim 10 wherein said fastening means further comprises shoelaces for drawing the lateral and medial side panel portions toward each other when tightened.

12. The shoe of claim 10 wherein said upper strap is releasably attachable to said medial side panel portion.

13. A method for fabricating an ankle-supporting shoe comprising the steps of:

attaching a midsole to a top surface of a sole member, said midsole including a planar portion attached to the top surface and a continuous flange formed partially about and extending upwardly from the planar portion;

attaching a brace member to an upper surface of the planar portion and a toe portion of the top surface of the sole member, said brace member including a single base portion sized to completely cover the upper surface of the planar portion and the toe portion of the top surface when attached thereto, and curved lateral and medial struts extending upwardly from the base portion; and attaching a boot to the sole member in a manner wherein said lateral strut extends upwardly between a lateral side panel portion of the boot and the flange, and said medial strut extends upwardly between a medial side panel portion of the boot and the flange.

14. The method of claim 12 further comprising the step of attaching the lateral strut to the lateral side panel portion and the medial strut to the medial side panel portion.

15. The method of claim 13 wherein said boot is attached to the sole member in a manner wherein said lateral strut extends upwardly within said lateral side panel portion and said medial strut extends upwardly within said medial side panel portion.

16. An ankle supporting shoe wearable on a wearer's foot having a plantar surface, ankle, heel, shin, lateral malleolus and medial malleolus, said shoe comprising:

a sole member defining lateral and medial edges and a generally planar top surface having heel, toe and central portions;

a boot attached to said sole member, said boot defining a toe portion, a vamp portion and an ankle portion surrounding the ankle, heel and lower shin of the wearer's foot when such is inserted into the boot, said ankle portion including lateral and medial side panel portions; and a brace member attached to the top surface of said sole member, comprising:

a base portion formed to suit the shape of the plantar surface of the wearer's foot and sized to extend along the entire length of the plantar surface of the wearer's foot; and curved lateral and medial struts extending upwardly from said base portion;

said lateral strut being formed and oriented on the base portion so as to extend upwardly along the lateral aspect of the ankle and about the front of the lateral malleolus and subsequently along the lower lateral and frontal aspects of the shin when the foot is inserted into the boot and the boot tightened; and said medial strut being formed and oriented on the base portion so as to extend upwardly along the medial aspect of the ankle and about the back of the medial malleolus and subsequently along the lower medial aspect of the shin when the foot is inserted into the boot and the boot tightened.

* * * * *